US011006499B2

(12) United States Patent
Huang et al.

(10) Patent No.: US 11,006,499 B2
(45) Date of Patent: May 11, 2021

(54) CONTROL METHOD FOR PLURALITY OF SETS OF SERIES-PARALLEL-CONNECTED LIGHT-EMITTING DIODES VIA SINGLE WIRE

(71) Applicant: Anapex Technology Inc., Hsinchu County (TW)

(72) Inventors: Tsung-Wen Huang, Hsinchu County (TW); Shih-Chung Cheng, Hsinchu County (TW); Chih-Ming Kao, Hsinchu County (TW)

(73) Assignee: ANAPEX TECHNOLOGY INC., Jhubei (TW)

( * ) Notice: Subject to any disclaimer, the term of this patent is extended or adjusted under 35 U.S.C. 154(b) by 0 days.

(21) Appl. No.: 16/871,909

(22) Filed: May 11, 2020

(65) Prior Publication Data

US 2020/0375004 A1 Nov. 26, 2020

(30) Foreign Application Priority Data

May 22, 2019 (TW) ..... 108117653

(51) Int. Cl.

| | |
|---|---|
| ***H05B 45/44*** | (2020.01) |
| ***H05B 45/32*** | (2020.01) |
| ***H05B 45/37*** | (2020.01) |
| ***H05B 45/20*** | (2020.01) |

(52) U.S. Cl.

CPC ..... *H05B 45/44* (2020.01); *H05B 45/32* (2020.01)

(58) Field of Classification Search

CPC ..... H05B 45/37; H05B 45/20; H05B 45/46; H05B 45/00; H05B 45/10; H05B 45/48; H05B 45/44; H05B 45/50; H05B 47/155; H05B 47/10; H05B 45/36

USPC ..... 315/291, 312, 185 R, 193, 294

See application file for complete search history.

(56) References Cited

U.S. PATENT DOCUMENTS 9,854,633 B1 12/2017 Lee et al.
2012/0001557 A1* 1/2012 Hagino ..... H05B 45/37 315/192

* cited by examiner

*Primary Examiner* — Wei (Victor) Y Chan
(74) *Attorney, Agent, or Firm* — Muncy, Geissler, Olds & Lowe, P.C.

(57) ABSTRACT

The invention provides a control method for sets of series-parallel-connected LEDs via a single wire. Step 1: providing an LED circuit including a control module and a light-emitting module. The light-emitting module includes LED strings connected to one another in parallel. Each of the LED strings includes a plurality of LED units connected in series to one another, and at least one counter comprising a counter start time different from that of another. Step 2: sending a setting signal by the control module, and allocating one identification code obtained sequentially in time to one of the LED string according to the different counter start times of the LED strings. Step 3: sending a designation signal to the light-emitting module by the control module, such that the LED string with the corresponding identification value is selected and independently controlled by the control module.

8 Claims, 5 Drawing Sheets

CONTROL METHOD FOR PLURALITY OF SETS OF SERIES-PARALLEL-CONNECTED LIGHT-EMITTING DIODES VIA SINGLE WIRE

FIELD OF THE INVENTION

The present invention relates to a control method for light-emitting diodes (LEDs), and particularly to a control method for a plurality sets of series-parallel-connected LEDs via a single wire.

BACKGROUND OF THE INVENTION

Light-emitting diodes (LEDs) are maturely and extensively applied in lighting, display and other fields. In order to maximize the performance of LEDs, apart from taking into account the material design of the LEDs, a control circuit driving the LEDs to emit light also plays a critical role.

In the circuit of LEDs, there is a configuration of a plurality of groups of series-connected LEDs connected in parallel by a single wire. With respect to a control circuit for such LEDs, the U.S. Pat. No. 9,854,633 provides an LED array and a light source device using the same. The LED array includes a plurality of LED strings connected in parallel to one another, wherein the LEDs are connected to one another in series. A sum of forward voltages of a plurality of corresponding light emitting devices included in at least one LED string among the plurality of LED strings is less than a sum of forward voltages of a plurality of corresponding light emitting devices included in a different LED string, and the at least one LED string includes a voltage compensation unit configured to compensate for a difference in forward voltage levels between the at least one LED string and the different LED string. Accordingly, with the arrangement of the voltage compensation unit, non-uniform current distribution can be mitigated.

In the described plurality of sets of series-parallel-connected LEDs via a single wire, a microcontroller unit (MCU) is usually connected to input terminals of the plurality of LED strings, such that the plurality of LEDs strings can receive only a signal sent from the MCU. Thus, the MCU can provide only uniform control to the LED strings and has a drawback of being incapable of flexibly providing diversified light emitting effects. Therefore, there is a need for an improvement.

SUMMARY OF THE INVENTION

The object of the present invention is to solve the issue of sets of series-parallel-connected light-emitting diodes (LEDs) via a single wire, in which only uniform control can be provided to LED strings and diversified light emitting effects cannot be flexibly provided.

To achieve the object, the present invention provides a control method for a plurality of sets of series-parallel-connected LEDs via a single wire. The control method includes the following steps.

Step 1: providing an LED circuit including a control module and a light-emitting module. The light-emitting module includes a plurality of LED strings connected to one another in parallel. Each of the plurality of LED strings includes a plurality of LED units connected in series to one another, and at least a counter that counts cyclically. The control module and the light-emitting module are connected in series via a single connection wire to form a series connection. The counters of the plurality of LED strings respectively comprise a counter start time different from that of another.

Step 2: sending a setting signal to the light-emitting module by the control module. Each of the plurality of LED strings sequentially obtains the setting signal according to the different counter start time of the counter, allocating identification code from a plurality of different identification codes to each of the plurality of LED strings according to an order of obtaining the setting signal, and defining the identification code as an identification value. The setting signal includes a setting instruction and a first identification instruction corresponding to the identification value.

Step 3: sending a designation signal to the light-emitting module by the control module, wherein the designation signal includes a designation instruction and a second identification code corresponding to the identification code, such that one of the plurality of LED strings with the corresponding identification value is selected and independently controlled by the control module.

Accordingly, the present invention is able to allocate different identification codes to the plurality of LED strings the counters essentially comprising different counter start times, such that the plurality of LED strings can be identified and be controlled separately, thus enhancing diversity of light emitting effects.

DETAILED DESCRIPTION OF THE PREFERRED EMBODIMENTS

Details and technical contents of the present invention are given with the accompanying drawings below.

Figure 1:
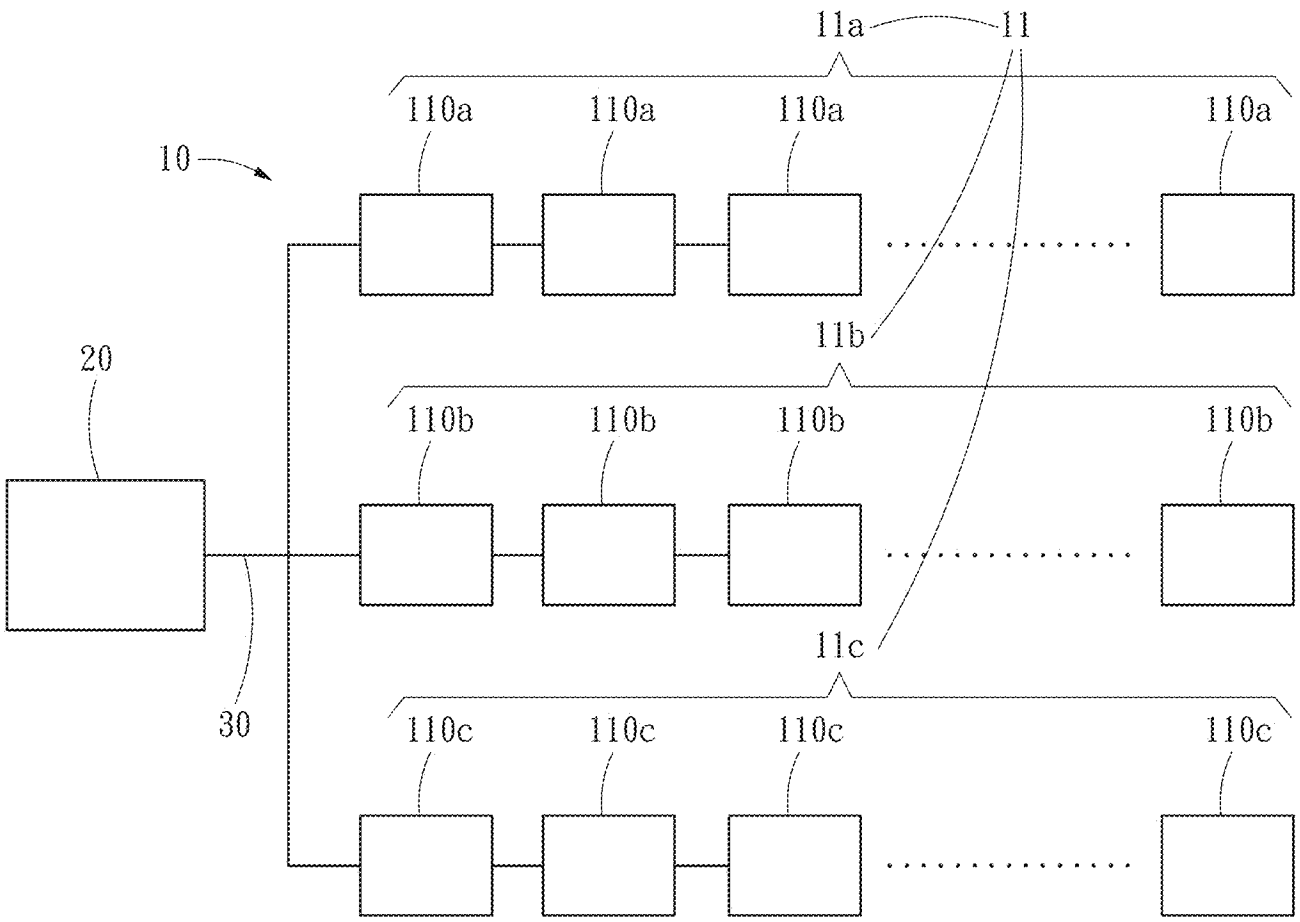
FIG. 1 is a block schematic diagram of a circuit according to an embodiment of the present invention.

A control method of the present invention is applied to a control or driver circuit for a plurality of sets of series-parallel-connected light-emitting diodes (LEDs) via a single wire. As shown in FIG. 1, the circuit includes a light-emitting module 10 and a control module 20. The light-emitting module 10 includes a plurality of LED strings 11, which includes a first LED string 11*a*, a second LED string 11*b* and a third LED string 11*c*. The first LED string 11*a*, the second LED string 11*b* and the third LED string 11*c* respectively include a plurality of first LED units 110*a*, a plurality of second LED units 110*b* and a plurality of third LED units 110*c*, wherein the LED units are connected in series to one another. The plurality of LED strings 11 are connected in parallel to one another, and are connected in series to the control module 20 by a single connection wire 30 to form a series connection. In one embodiment of the present invention, the control module 20 is a microcontroller unit (MCU).

Figure 2:
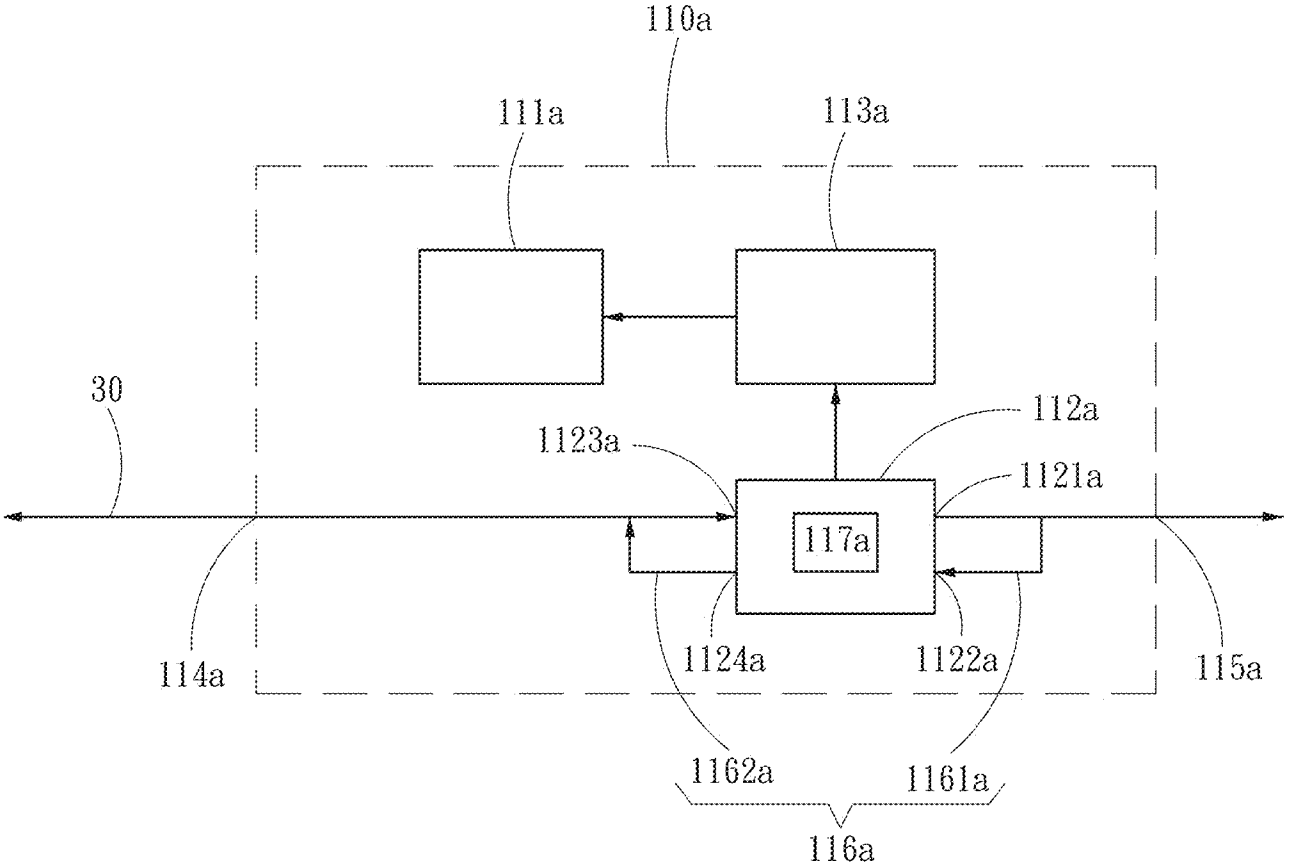
FIG. 2 is a block schematic diagram of a first light-emitting diode (LED) unit according to an embodiment of the present invention.

Referring to FIG. 2, the first LED unit 110*a* is taken as an example for illustration. The first LED unit 110*a* includes at least one LED 111*a*, a driver chip 112*a*, a power source 113*a*, a first output/input terminal 114*a*, a second output/input terminal 115*a*, and a feedback line 116*a*. The LED 111*a* and the driver chip 112*a* are electrically connected. Further, the power source 113*a* is connected between the LED 111*a* and the driver chip 112*a*, and the power source 113*a* provides the power to the LED 111*a* for emitting light. The feedback line 116*a* includes a first feedback section 1161*a* and a second feedback section 1162*a*. The first feedback section 1161*a* is connected between an output terminal 1121*a* and a feedback input terminal 1122*a* of the driver chip 112*a*, and the second feedback section 1162*b* is connected between an input terminal 1123*a* and a feedback output terminal 1124*a* of the driver chip 112*a*, hence forming a feedback path at the driver chip 112*a*. In the embodiment, the driver chip 112*a* includes a pulse-width modulation (PWM) counter 117*a*.

The control method of the present invention is described with reference to the circuit in FIG. 1, and includes the following steps.

Step 1: providing an LED circuit which includes a light-emitting module 10 and a control module 20. The light-emitting module 10 includes a plurality of LED strings 11 connected in parallel to one another. The plurality of LED strings 11 includes a first LED string 11*a*, a second LED string 11*b* and a third LED string 11*c*. The first LED string 11*a*, the second LED string 11*b* and the third LED string 11*c* respectively include a plurality of first LED unit 110*a*, a plurality of second LED unit 110*b* and a plurality of third LED unit 110*c*, wherein the LED units are connected in series to one another. Further, each of the first LED string 11*a*, the second LED string 11*b* and the third LED string 11*c* includes at least one counter that counts cyclically.

Figure 3:
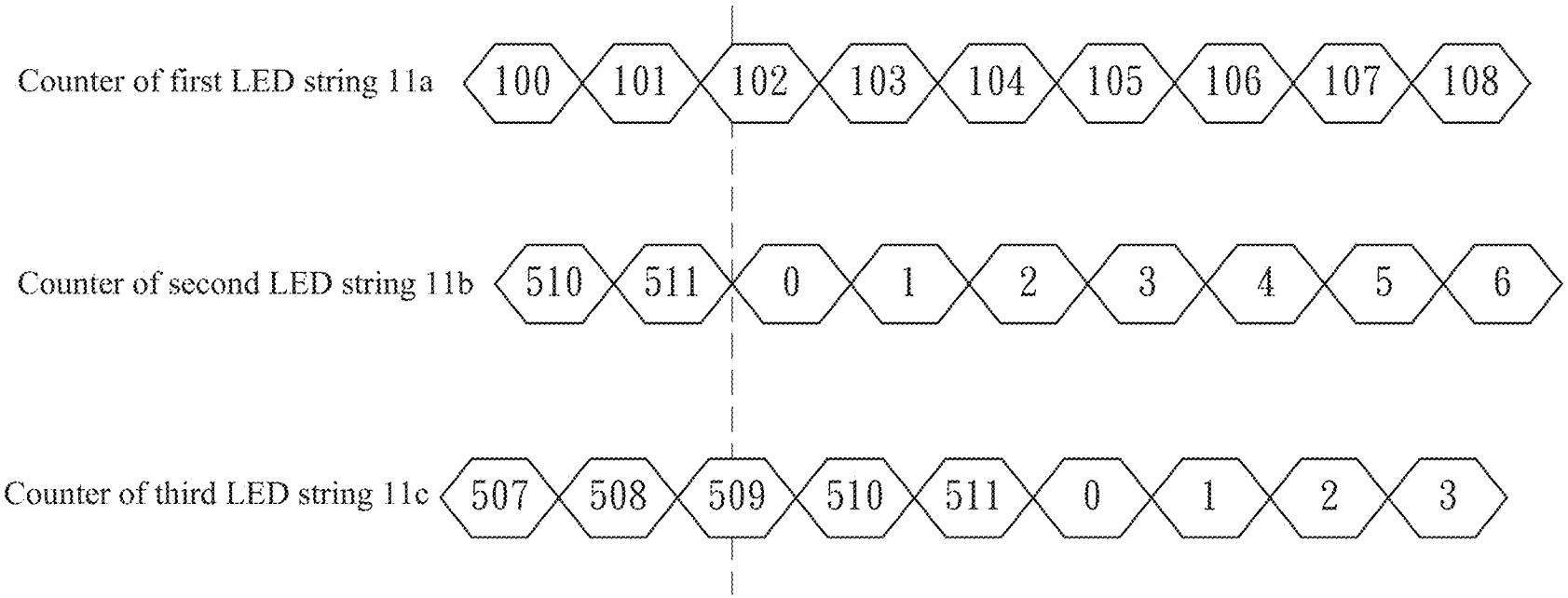
FIG. 3 is a schematic diagram of counter start times of counters according to an embodiment of the present invention.

In the embodiment, the counter is a PWM counter 117*a*, and the driver chip of each of the LED units includes the PWM counter. In other words, the driver chip of each LED unit includes the counter. The control module 20 and the light-emitting module 10 are connected in series by a single connection wire 30 to form a series connection. The counters of the plurality of LED strings 11 connected in parallel respectively comprises a counter start time different from that of another. In other words, the counter start times of the counters are shifted from one another and do not overlap one another. The different counter start times are shown as FIG. 3. In the embodiment, "one cycle" is defined as the counter counting up to "511", and the horizontal axis shown in FIG. 3 is regarded as time. When the counter of the first LED string 11*a* counts to "102", the counter of the second LED string 11*b* counts to "511", and the counter of the third LED string 11*c* counts to "509". In the embodiment, the count is based on the counter of the driver chip in the leading LED unit of the LED string 11. In the present invention, the same LED strings 11 are differentiated by the different counter start times essentially comprised in the counters.

Step 2: sending a setting signal to the light-emitting module 10 by the control module 20. Each of the plurality of LED strings 11 sequentially obtains the setting signal according to the different counter start time of the counter. Further, allocating one identification code from a plurality of different identification codes to each LED string 11 according to the order of obtaining the setting signal, wherein the identification code is defined as an identification value of the LED string 11. In the embodiment, the identification code includes predetermined values "3", "5" and "11". When the counter of the second LED string 11*b* first counters to "511", the second LED string 11*b* stores "5" as the identification code; the third LED string 11*c* that next counts to "511" stores "3" as the identification code, and the first LED string 11*a* that last counts to "511" stores "11" as the identification code. One of the plurality of LED strings 11 which is defined with the identification code outputs a pulse to notify the control module 20 and the other LED strings 11, and the pulse is returned to the control module 20 through the feedback line 116*a*. In other words, the identification values of the first LED string 11*a*, the second LED string 11*b* and the third LED string 11*c* are "11", "5" and "3", respectively. These above values are examples only, and the expression of the identification code may be modified according to the actual application.

Step 3: sending a designation signal to the light-emitting module 10 by the control module 20, wherein the designation signal corresponds to the identification value. One of the plurality of LED strings 11 with the identification value is selected and independently controlled by the control module 20. Once the control module 20 has issued the designation signal, all of the first LED string 11*a*, the second LED string 11*b* and the third LED string 11*c* receive the designation signal; however, only the LED string 11 with the corresponding identification code performs a corresponding function. In the embodiment, only the LED string 11 allocated with the corresponding identification code passes on the designation signal backward. Thus, although only one control module 20 is provided for the plurality of LED strings 11 which are series-parallel-connected by a single wire, the invention allocates the identification codes to the plurality of LED strings 11, so that each of the plurality of LED strings 11 can be differentiated from another according to the stored identification code, allowing the control module 20 to independently control a specific LED string 11. Thus, the invention is able to achieve the diversified light emitting effects.

Figure 4:
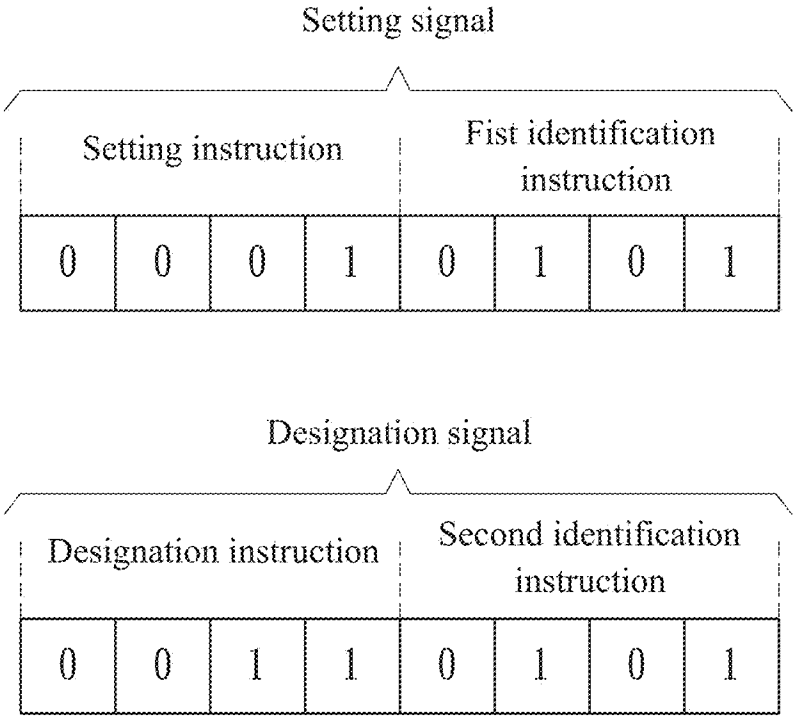
FIG. 4 is a schematic diagram of a setting signal and a designation signal according to an embodiment of the present invention.
Figure 5:
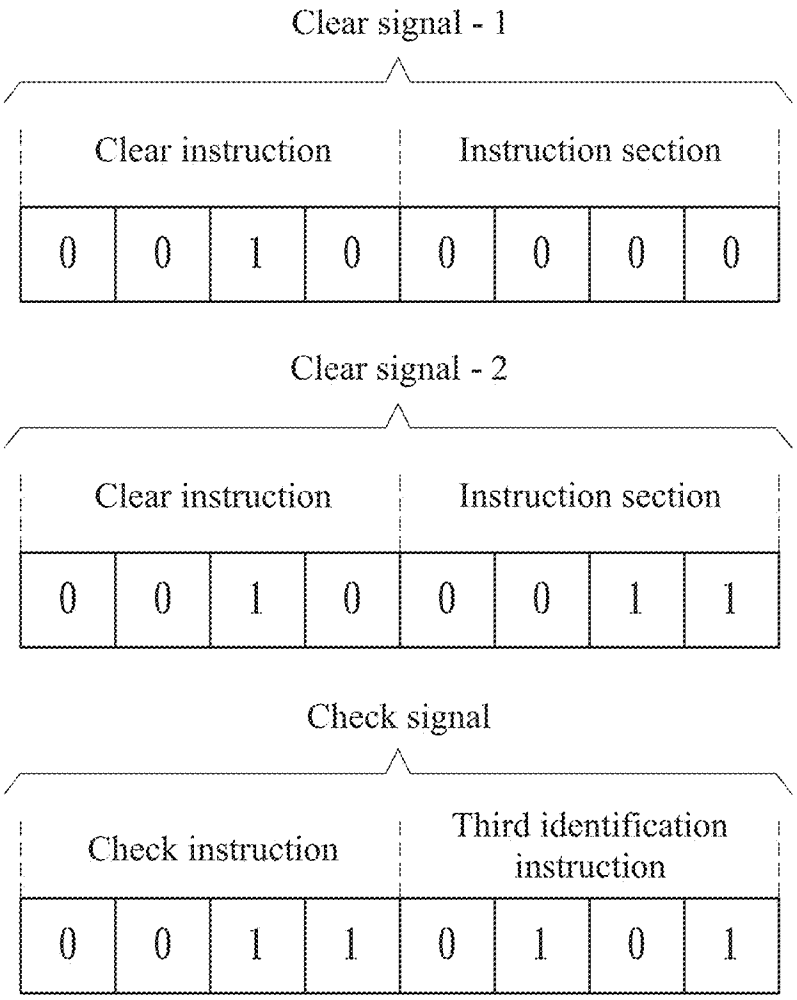
FIG. 5 is a schematic diagram of a clear signal and a check signal according to an embodiment of the present invention.

In the present invention, the setting signal includes a setting instruction and a first identification instruction corresponding to the identification value. The designation signal includes a designation instruction and a second identification instruction corresponding to the identification value. In one embodiment, as shown in FIG. 4, the setting signal and the designation signal are exemplified by 4-bit signals. Before step 2 is performed or at other times, the control module 20 sends a clear signal to the light-emitting module 10, such that all the identification codes of the plurality of LED strings 11 in the light-emitting module 10 become a reference code. The clear signal comprises two types, one of which is clearing the identification values of all the plurality of LED strings 11, and the other is clearing the identification value of a specific LED string 11. As shown by a "clear signal-1" and a "clear signal-2" in FIG. 5, the "clear signal-1" includes a clear instruction and an all-zero instruction section, and the "clear signal-2" includes a clear instruction and an instruction section corresponding to the identification value. In addition, the control module 20 sends a check signal to the light-emitting module 10. The check signal includes a check instruction and a third identification instruction corresponding to the identification value, as shown in FIG. 5. One of the plurality of LED string 11 which corresponds to the third identification instruction outputs a pulse upon receiving the check signal, and the pulse is returned to the control module 20 through the feedback line 116*a*.

Accordingly, the present invention is able to allocate different identification codes to the plurality of LED strings by the counters essentially comprising different counter start times, such that the plurality of LED strings can be identified and be controlled separately, thus enhancing the diversity of light emitting effects.

What is claimed is:

1. A control method for a plurality of sets of series-parallel-connected light-emitting diodes (LEDs) via a single wire, comprising:

step 1: providing an LED circuit, the LED circuit comprising a control module and a light-emitting module, the light-emitting module comprising a plurality of LED strings connected to one another in parallel, each of the plurality of LED strings comprising a plurality of LED units connected in series to one another, and one or more counter that counts cyclically, the control module and the light-emitting module connected in series via a single connection wire to form a series connection, the plurality of counters of the plurality of LED strings respectively comprise a counter start time different from another counter;

step 2: sending a setting signal to the light-emitting module by the control module, wherein each of the plurality of LED strings sequentially obtains the setting signal according to the different counter start time of the counter, allocating one identification code from a plurality of different identification codes to each of the plurality of LED strings according to an order of obtaining the setting signal, and defining the identification code as an identification value of the LED string, wherein the setting signal comprises a setting instruction and a first identification instruction corresponding to the identification value; and step 3: sending a designation signal to the light-emitting module by the control module, the designation signal comprising a designation instruction and a second identification instruction corresponding to the identification value, such that one of the plurality of LED strings with the corresponding identification value is selected and independently controlled by the control module.

2. The control method of claim 1, wherein the control method further comprises the following step:

sending a clear signal to the light-emitting module by the control module, such that all the identification values of the plurality of LED strings of the light-emitting module are a reference code.

3. The control method of claim 1, wherein the control method further comprises the following step:

sending a check signal to the light-emitting module by the control module, the check signal comprises a check instruction and a third identification instruction corresponding to the identification value; and outputting a pulse by one of plurality of the LED strings which corresponds to the third identification instruction when receiving the check signal.

4. The control method of claim 3, wherein the pulse is returned to the control module through a feedback line.

5. The control method of claim 1, wherein one of the plurality of LED strings defined with the identification value outputs a pulse.

6. The control method of claim 5, wherein the pulse is returned to the control module through a feedback line.

7. The control method of claim 1, wherein the control method further comprises the following step after step 2:

sending a clear signal to the light-emitting module by the control module, such that the identification value of each of the plurality of LED strings of the light-emitting module is a reference code.

8. The control method of claim 1, wherein the counter start times of the counters are shifted from one another counter and do not overlap.

* * * * *